US006276901B1

(12) United States Patent
Farr et al.

(10) Patent No.: US 6,276,901 B1
(45) Date of Patent: Aug. 21, 2001

(54) COMBINATION SIGHT GLASS AND SUMP OIL LEVEL SENSOR FOR A HERMETIC COMPRESSOR

(75) Inventors: James B. Farr, Ann Arbor; Kent B. Herrick, Manchester, both of MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/459,519

(22) Filed: Dec. 13, 1999

(51) Int. Cl.[7] ..... F04B 49/10

(52) U.S. Cl. ..... 417/13; 417/63; 340/619; 62/129; 62/193; 73/293

(58) Field of Search ..... 417/13, 36, 44.1, 417/63, 228; 340/619, 514; 62/126, 129, 193; 73/293

(56) References Cited

U.S. PATENT DOCUMENTS

| | | | | |
|---|---|---|---|---|
| 4,193,004 | | 3/1980 | Lobdell et al. . | |
| 4,440,022 | | 4/1984 | Masom . | |
| 4,788,444 | * | 11/1988 | Williams | 73/293 |
| 4,840,137 | | 6/1989 | Beauvais et al. . | |
| 4,961,069 | | 10/1990 | Tsaprazis | 340/619 |
| 4,962,395 | | 10/1990 | Baird . | |
| 4,984,462 | | 1/1991 | Hass, Jr. et al. . | |
| 4,998,022 | | 3/1991 | Tregay . | |
| 5,029,471 | | 7/1991 | Goodrich | 73/293 |
| 5,072,595 | | 12/1991 | Barbier . | |
| 5,103,648 | | 4/1992 | Barbier | 62/126 |
| 5,161,411 | | 11/1992 | Cruickshank . | |
| 5,164,606 | * | 11/1992 | Secord | 73/293 |
| 5,278,426 | | 1/1994 | Barbier | 250/577 |
| 5,295,359 | | 3/1994 | Reilly, Jr. et al. . | |
| 5,381,022 | | 1/1995 | Nemeth et al. . | |
| 5,399,876 | | 3/1995 | LaClair . | |
| 5,763,776 | | 6/1998 | Birch et al. . | |
| 5,765,994 | * | 6/1998 | Barbier | 417/13 |
| 5,784,232 | | 7/1998 | Farr . | |
| 5,884,494 | | 3/1999 | Okoren et al. | 62/126 |
| 5,889,284 | | 3/1999 | Mattis | 250/577 |

* cited by examiner

*Primary Examiner*—Cheryl J Tyler
(74) *Attorney, Agent, or Firm*—Baker & Daniels

(57) ABSTRACT

A combination sight glass and optical sensor is provided in the housing of a hermetic compressor to provide effective visual inspection in addition to automatic sensing of the level of oil in an oil sump. A sight glass fitting is provided in the housing and has a first portion that extends outwardly from the housing and that is accessible from outside the compressor. An optical oil level sensing device is removably attached to the first portion of the sight glass with electrical leads extending outside the compressor for connection to a compressor controller. A prism or similar device is attached to the sight glass fitting intermediate the sump oil and the optical sensor. The sensing device includes a light source, a photosensitive detector, and an opaque member to prevent cross coupling between the light source and the detector. Should the oil level in the oil sump fall below a predetermined level, the optical sensor sends a low oil level signal to the controller which interrupts power to the compressor or generates an alarm or status signal. A technician may remove the optical sensor from the sight glass fitting and visually inspect the oil level by looking through the sight glass fitting and prism and into the interior of the compressor housing. One embodiment of the optical sensor will also provide a low oil level signal to the controller when the optical sensor is disengaged or removed from the sight glass.

15 Claims, 6 Drawing Sheets

COMBINATION SIGHT GLASS AND SUMP OIL LEVEL SENSOR FOR A HERMETIC COMPRESSOR

BACKGROUND OF THE INVENTION

1. Field of the invention.

The present invention relates to devices for sensing the level of oil in oil sumps in hermetic refrigeration and air conditioning compressors, such as scroll, reciprocating or rotary types, and more particularly to devices for optically inspecting and automatically sensing the level of oil in sumps. One aspect of the present invention relates to sight glass type devices attached to the housing of a compressor for allowing a person to visually examine the interior of the compressor from outside the compressor housing to determine the level of oil in an oil sump or to examine the surface of oil in a sump. Another aspect of the present invention relates to automatic sensing devices that optically sense the presence or level of oil in an oil sump and perform some desired function, such as alarm or service indication or compressor shut down, in the event the oil level becomes critically low.

2. Description of the related art.

The most common form of oil level sensing device utilized today and in the past in hermetic compressors is the mechanical float switch. A float is supported by oil in the sump of a compressor and with the oil at an acceptable level the switch maintains contact between a power source and the compressor. Should the oil, and the float supported thereby, drop below a threshold level, then the switch interrupts the power supply to the compressor and thereby terminates operation. A problem associated with magnetic float switches is that they generally utilize a magnetic reed switch which attracts metallic debris that binds the float switch and causes the device to become inoperable resulting in unnecessary compressor shut down or the loss of compressor protection. This type of device is wholly mounted internal the compressor housing requiring costly compressor disassembly to replace a malfunctioning switch.

Sight glass instruments have been incorporated in hermetic compressors to permit visual inspection of the level or presence of oil in a sump. Such sight glass instruments require an operator to periodically examine the compressor to verify that an acceptable level of oil is present in the sump. A problem with such sight glass instruments is that usually compressors are mounted in the interior of an outer housing of other devices, such as refrigerators, air conditioners, automobiles, etc., and, even if positioned most favorably, are difficult to examine and may require some disassembly. Another problem with such devices is that in the event of sudden catastrophic loss of oil in a sump, no advance warning is given and damage occurs without the opportunity for remedial measures.

Automatic oil level sensing devices are known which are generally mounted wholly in the interior of a compressor housing and electrically connected to the compressor power source via electrical leads which extend from the interior of the housing to the outside of the housing through a hermetic outlet in the housing. Typically, the leads are connected to the power source external of the compressor housing. When the sensor determines that the level of oil in the sump has dropped below a critical threshold level, the sensor, via switching contacts, relay contacts, TTL logic, etc., automatically interrupts the delivery of power to the compressor and operation is terminated. One problem with such known sensors is that the only way to verify the existence of a fault condition is to disassemble the compressor, no visual inspection is provided.

Often it is the sensor that has failed and has erroneously terminated compressor operation when in fact a sufficient level of oil is present in the sump. Again, the only way to determine this is to disassemble the compressor unless a second device, such as a sight glass described above, is also incorporated in the compressor. However, if the sensor has in fact failed then it is still necessary to disassemble the compressor to replace the failed sensor. This is not an economically desirable option but the only other alternative is to electrically bypass the failed sensor and permit unprotected compressor operation.

A problem with externally mounted sensors is that the sensor continues to sense an acceptable oil level after having fallen off or been removed from the sight glass. This situation may lead to damage to the compressor if the oil level does become low.

SUMMARY OF THE INVENTION

The present invention provides a combination oil sight glass and optical sensor for determining the level of oil in a sump of a hermetic refrigeration compressor. An oil sight glass is disposed in the bottom portion of the housing of a compressor at approximately the lowest acceptable level of the oil in the sump. The sight glass fitting is generally hollow and is hermetically sealed to the compressor housing. The hollow sight glass has a first end portion adjacent the oil sump and an opposite second end portion which preferably extends outwardly from the side of the housing external of the compressor. A prism, or other such device, is disposed in the sight glass at a first end portion of the sight glass and is optically accessible via the hollow sight glass from outside the compressor. The prism part may be placed anywhere along the length of the sight glass fitting, but is preferably located outside the compressor housing at a position most easily viewed by a person maintaining the compressor. With the sight glass placed in the housing of a compressor, an individual may visually examine the level of oil in the sump by looking through the sight glass and prism and into the interior of the compressor.

In combination with the prism, an optical sensor is removably disposed in, on, or about the sight glass. The optical sensor, through the separate prism of the sight glass, automatically senses the level of oil in the sump and generates a signal or trips a switch or otherwise breaks contacts when the level becomes critically low or exceeds a predetermined operating range. Electrical leads extend outwardly from the optical sensor external of the compressor and are connected to the electrical connections of the compressor or other devices so as to achieve a desired function.

For example, the leads of the optical sensor, which may be a combination sensor and switch, may be placed in series with the compressor power source, directly or via the contacts of a relay, to automatically terminate compressor operation in the event a critically low oil level is sensed. This prevents the compressor from becoming damaged due to insufficient lubrication. Alternatively, the leads of the sensor may be connected to a compressor controller, an alarming device, or some electronic protection circuit, for automatically generating a fault indication alarm upon the occurrence of a predetermined condition. The alarm, which may take the form of a flashing light, a horn, a remote indication, etc., gains the attention of an operator who may then visually verify the existence of a fault condition via the sight glass by removing the optical sensor and looking through the sight glass and prism and into the interior of the compressor housing. The signal generated by the sensor may be input to a facility management control system to provide enhanced maintenance capabilities and reporting.

In this manner, the present invention provides an automatic sensing device which may be removed from the compressor from outside of the compressor and which has electrical leads that may be disconnected from the compressor from outside the compressor. Accordingly, the present invention provides a simplified method of replacing a failed sensor without disassembling the compressor. The present invention further provides an integral sight glass that permits visual examination of the oil level in the sump to confirm a low oil level fault condition as sensed by the optical sensor.

The sight glass and sensor combination of the present invention may be used in reciprocating compressors, scroll compressors, and rotary compressors, such as disclosed in U.S. Pat. Nos. 5,266,015, 5,306,126, and 5,236,318, respectively, which are incorporated herein by reference.

The invention comprises, in one form thereof, a hermetic compressor comprising a housing, a motor receiving power through a controller from a power source, a compressor mechanism driven by said motor, an oil sump in said housing for holding lubricating oil therein, and an oil level sensing and viewing device. The oil level sensing and viewing device comprises a sight glass hermetically attached to said housing and an optical sensor removably mounted on said sight glass and electrically connected to the controller. The optical sensor may be removed from the sight glass from outside the housing. The optical sensor includes a light source, a photosensitive detector, and an opaque cylinder and adapted to sense the level of oil in the oil sump. The opaque cylinder includes a pair of bores. The light source and the detector are disposed within the bores preventing cross coupling between the light source and the detector. With the optical sensor removed from the sight glass a person may visually examine the level of oil in the oil sump by looking through the sight glass. With the optical sensor disposed on the sight glass and sensing a low oil level in the oil sump, the optical sensor sends a low oil level signal to the controller that interrupts the power to the motor thereby terminating compressor operation.

In a second form, the present invention comprises a hermetic refrigeration compressor comprising a housing, a motor receiving power through a controller from a power source, a compressor mechanism driven by said motor, an oil sump in said housing for holding lubricating oil therein, and an oil level sensing and viewing device. The oil level sensing and viewing device comprises a sight glass hermetically attached to said housing and an optical sensor removably mounted on said sight glass and electrically connected to the controller. The optical sensor is adapted to sense the level of oil in the oil sump and includes a housing, a light source, a photosensitive detector and a blocking member. The blocking member has a first position and a second position within the sensor housing. The first position is disposed between the light source and the detector preventing optical cross coupling when the optical sensor is attached to the sight glass. The second position is disposed away from the light source and the detector allowing cross coupling when the optical sensor is removed from the sight glass. The optical sensor may be removed from the sight glass from outside the housing and will send a low oil level signal to the controller to terminate compressor operation when removed from the sight glass. With the optical sensor removed from the sight glass a person may visually examine the level of oil in the oil sump by looking through the sight glass. With the optical sensor disposed in the sight glass and sensing a low oil level in the oil sump, the optical sensor sends a low oil level signal to the controller that interrupts the power to the motor thereby terminating compressor operation.

An advantage of the present invention is the ability to easily replace a defective oil level sensor from outside the compressor housing without disassembling the compressor.

Another advantage is the ability to externally visually check the level of oil in an oil sump or to visually verify a sensed low level condition after an optical sensor has terminated compressor operation.

Another advantage is that with the sensing device located essentially outside of the compressor, it is not subjected to the harsh environmental conditions suffered by such devices mounted wholly inside the compressor.

Yet another advantage is that cross coupling between the LED and the phototransistor is prevented by the opaque portions.

A further advantage is that the optical sensor will not allow the compressor to operate when it is not disposed on the sight glass in a position to sense the oil level.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
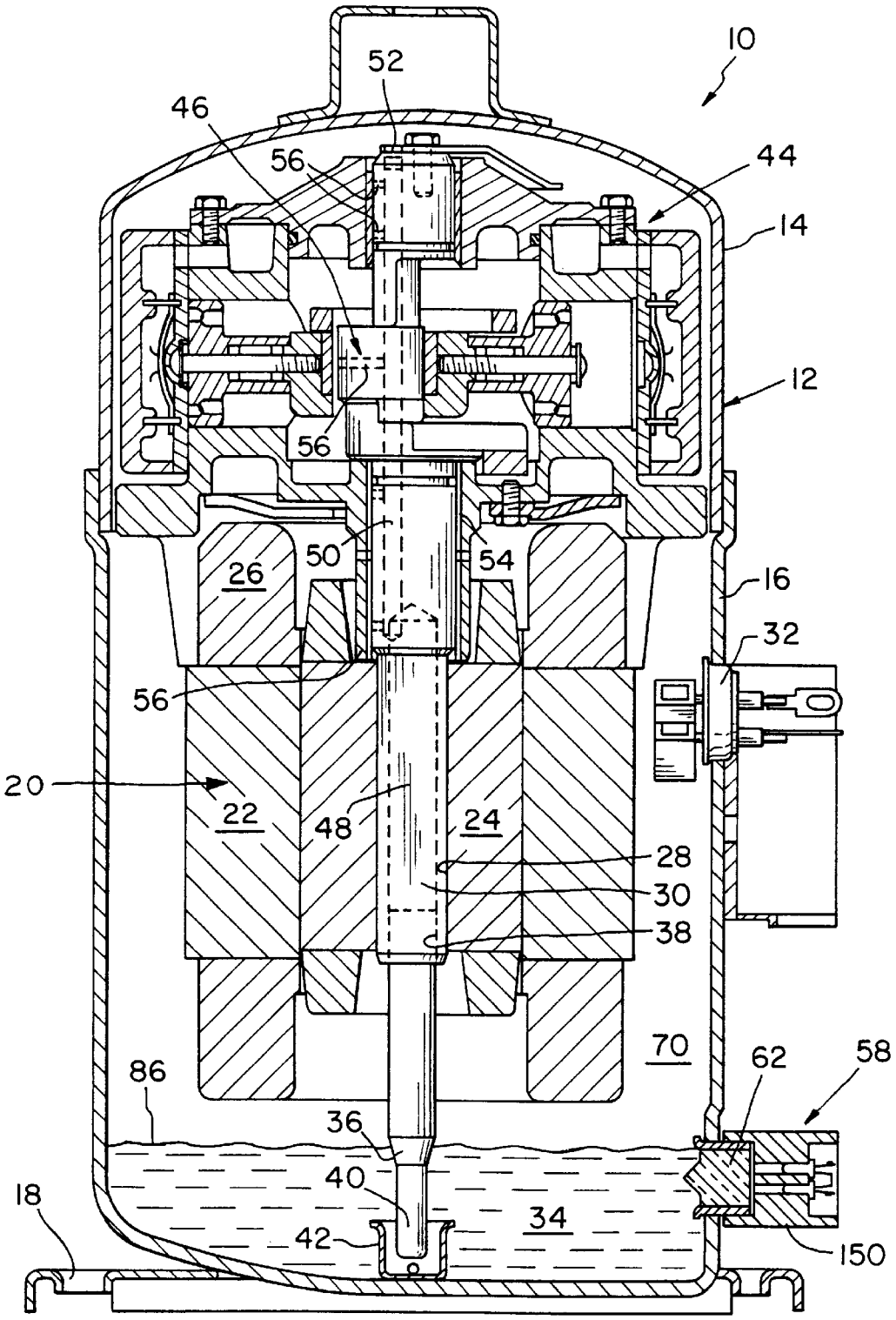
FIG. 1 is a sectional view of a reciprocating refrigeration compressor incorporating the combination sight glass and optical sensor of one form of the present invention.

In an exemplary embodiment of the invention as shown in the drawings, and in particular by referring to FIG. 1, a compressor, referenced generally at 10, is shown having a housing generally designated at 12. Although a reciprocating type compressor is illustrated in the drawings, this embodiment is only provided as an example and the invention is not limited thereto, but rather is applicable to all hermetic compressor applications. Housing 12 is shown having upper housing portion 14 and lower housing portion 16 and is supported by mounting flange 18 which is welded to bottom portion 16 for mounting the compressor in a vertically upright position. Located within hermetically sealed housing 12 is an electric motor, generally designated at 20, having stator 22 surrounding rotor 24. Stator 22 is secured within housing 12 by an interference fit such as by shrink fitting, and is provided with windings 26. Rotor 24 has central aperture 28 provided therein into which is secured crankshaft 30 such as by interference fit. A terminal cluster 32 is provided in housing 12 for connecting motor 20 to a source of electric power.

Compressor 10 also includes an oil sump 34 generally located in the bottom portion 16. A centrifugal oil pick-up tube 36 is press fit into counter bore 38 in the lower end of crankshaft 30. Oil pick-up tube 36 is of conventional construction and includes a vertical paddle (not shown) enclosed therein. An oil inlet end 40 of pick up tube 36 extends downwardly into the open end of a cylindrical oil cup 42, which provides a quiet zone from which high quality, non-agitated oil is drawn.

Compressor 10 includes a lubrication system for lubricating the moving parts of the compressor, including a reciprocating compressor mechanism, referenced generally at 44, crankshaft 30, and crank mechanism, referenced generally at 46. An axial oil passageway 48 is provided in crankshaft 30, which communicates with tube 36 and extends upwardly along the central axis of crankshaft 30. At a central location along the length of crankshaft 30, an offset, radially divergent oil passageway 50 intersects passageway 48 and extends to an opening 52. As crankshaft 30 rotates, oil pick-up tube 36 draws lubricating oil from oil sump 34 and causes oil to move upwardly through oil passageways 48 and 50. Lubrication of bearing 54 and crank mechanism 46 is accomplished by means of flats formed in crankshaft 30, located in the general vicinity of bearing 54 and crank mechanism 46, and communicating with oil passageways 48 and 50 by means of radial passages 56.

Figure 2:
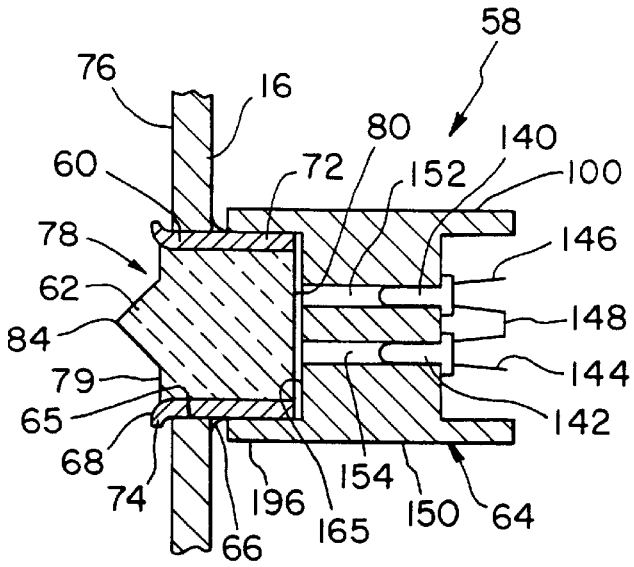
FIG. 2 is a cross-sectional view of the combination sight glass and optical sensor of FIG. 1 shown mounted in the housing of the compressor.

An oil level sensing and viewing device, referenced generally at 58, is provided in lower housing portion 16 and is hermetically sealed thereto. The particular placement of oil sensing/viewing device 58 is dependent upon the desired minimum level of oil in oil sump 34. The oil level sensing/viewing device should be mounted on lower housing portion 16 such that the middle of the device is at the lowest acceptable oil level in oil sump 34. Oil level sensing/viewing device 58 includes sight glass fitting 60, prism 62, and optical sensing device 64. Sight glass fitting 60 is received in an opening 65 formed in lower housing portion 16 and is hermetically sealed to the housing by means of projection welding or the like at joint 66 as shown in FIG. 2. Fitting 60 is generally hollow and tubular in shape and includes inward end portion 68, which is received in interior 70 of housing 12 and outward end portion 72 which extends outwardly from housing 12 and is exposed and readily accessible.

Inward end portion 68 is provided with a protruding annular collar 74 which engages inner surface 76 of lower housing portion 16. Inward end portion 68 is further provided with an opening 78, which receives prism 62. Prism 62 is fixably attached to sight glass fitting 60 by means of an adhesive, a deflectable flange about opening 78, or any other suitable means. Rear surface 80 of prism 62 extends to the outermost portion of outward end portion 72 of sight glass fitting 60. Prism 62 includes face 79 that faces inwardly toward and perpendicular to the oil level in sump 34. Face 79 is provided with an outwardly extending point 84 which establishes the low level threshold point of the oil in sump 34.

Figure 3:
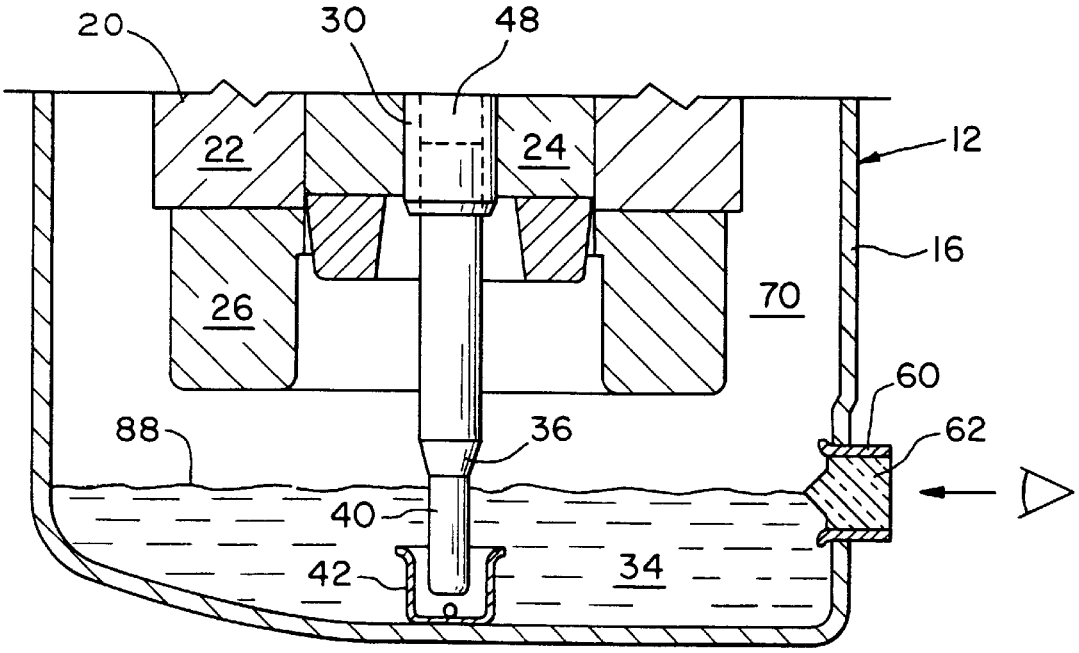
FIG. 3 is a partial sectional view of the bottom portion of the compressor of FIG. 1 illustrating the combination sight glass and optical sensor with the optical sensor removed for visual inspection of the oil level in the oil sump via the sight glass.

Oil sensing/viewing device 58 should be mounted such that point 84 is maintained below the acceptable and expected oil level throughout all phases of compressor operation. More importantly, oil sensing/viewing device 58 should be mounted on housing 12 such that outwardly extending point 84 of prism 62 is at that level below which the volume of oil in sump 34 is unacceptable. For example, as shown in FIG. 1, oil level 86 is clearly above outwardly extending point 84 as desired for proper compressor lubrication. Oil level 88, as shown in FIG. 3, is level with outwardly extending point 84 of prism 62 and therefore represents the lowest acceptable oil level to be permitted in sump 34. Should oil level 88 recede below outwardly extending point 84, then the oil level is unacceptable and the compressor is shut down.

Oil level sensing device 64 includes opaque cylinder 150, LED 140, and phototransistor 142 and is introduced around outward end portion 72 of sight glass fitting 60. Opaque molded plastic cylinder 150 is provided with a cylindrical forward portion 196 which surrounds outward end portion 72 of sight glass fitting 60. Outward end portion 72 provides a stop to limit the movement of oil level sensing device 64 in a direction toward housing 12 with surface 165 of opaque cylinder abutting rear surface 80 of prism 62. Oil level sensing device 64 may be sealably attached to fitting 60 by 0-rings or the like and is external to housing 12 and readily accessible from outside compressor 10. Oil level sensing device 64 may be may be securedly attached to fitting 60 by means such that unintended de-coupling is prevented, or may be easily removable from fitting 60 to permit removal by unaided hand operation.

Opaque cylinder 150 includes a pair of bores 152, 154 for LED 140 and phototransistor 142, respectively, such that cross coupling between LED 140 and phototransistor 142 is prevented from either sideways coupling or by refection from rear surface 80 of prism 62.

Figure 10:
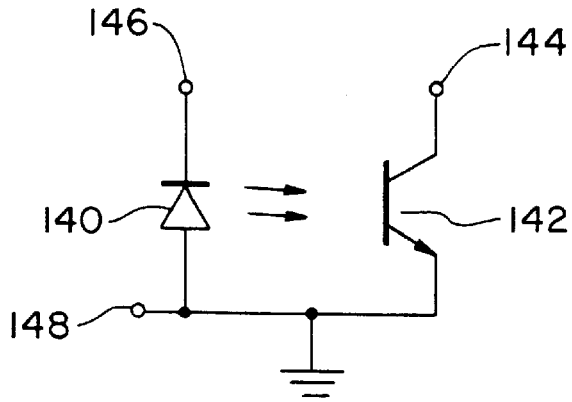
FIG. 10 is a schematic diagram of the LED and phototransistor circuit in the optical sensor.
Figure 11:
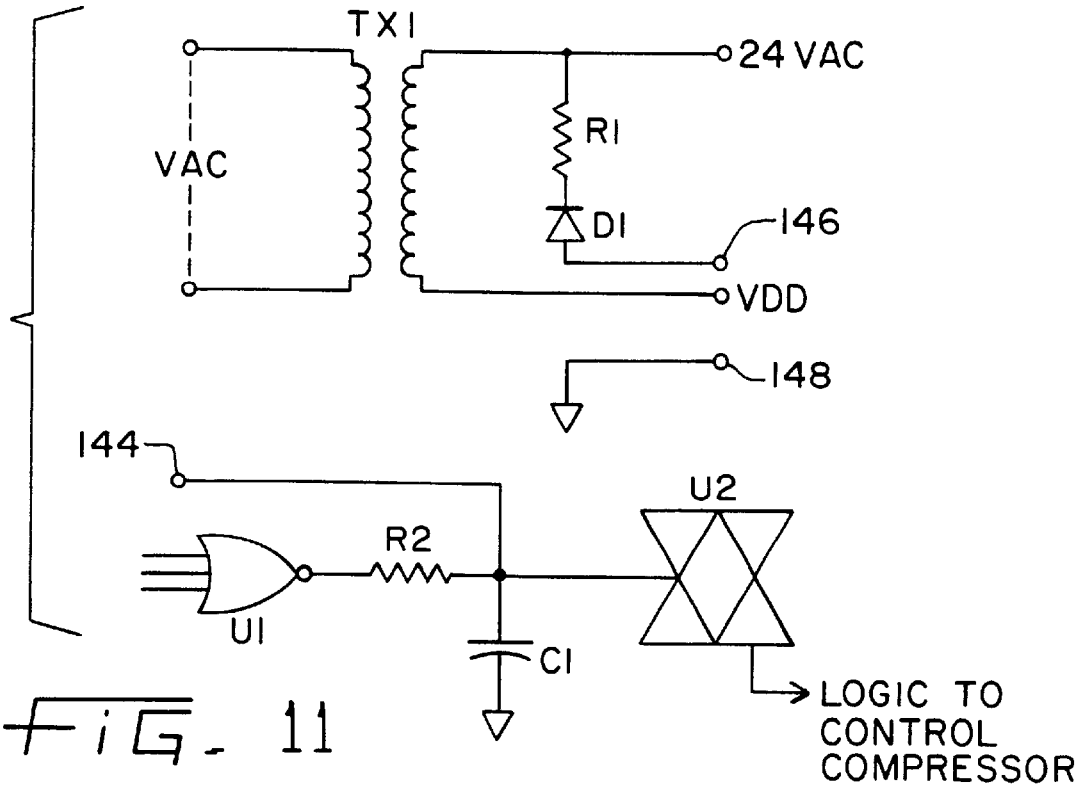
FIG. 11 is a schematic diagram of the interface circuitry on a controller that connects to the LED and phototransistor circuit shown in FIG. 10.

As shown in FIG. 10, the anode of LED 140 is electrically connected to the emitter of phototransistor 142, requiring only three electrical leads for operation of oil sensing device 64. Electrical leads 144, 146, 148 extend from oil level sensing device 64 and are electrically connected to a compressor control circuit (FIG. 11). The compressor control circuit provides a half-wave rectified voltage to LED 140 on lead 146 and a ground to LED 140 and phototransistor 142 on lead 148. The input AC voltage to the compressor control circuit is fed into transformer TX1, resulting in a 24 VAC output from transformer TX1 which forms the basis for the system's DC power supply. The 24 VAC is conditioned by resistor R1 and diode D1 to the half-wave rectified voltage provided to LED 140 on lead 146. Oil level sensing device 64 provides an oil level signal to the compressor control circuit on lead 144, which is either an open circuit or oscillates between an open circuit and ground at the same rate as the supplied half-wave rectified voltage. Resistor R2 and capacitor C1 of the compressor control circuit filter the oil level signal to bilateral switch U2, thus converting the output on lead 144 to a DC level. Switch U2 controls the operation of the compressor from a number of factors which are fed to switch U2 through gate U1 and by the oil level signal.

In operation, LED 140 emits a beam of light which passes through bore 152 and prism 62 and into oil sump 34, and phototransistor 142 receives any light returned through prism 62 and bore 154. The threshold point for a low level oil indication is outwardly extending point 84 of prism 62. If the compressor oil level is above point 84, then the beam of light from LED 140 passes into the oil and is not returned to phototransistor 142. Phototransistor 142 remains off and lead 144 displays an open circuit, allowing gate U1 to control switch U2. Gate U1 receives compressor protection inputs that can shut down compressor 10. If the compressor oil level falls below point 84, then the beam of light from LED 140 refracts in prism 62 back through bore 154 to phototransistor 142 turning it on and providing an oscillating ground on lead 144 which is filtered to a low logic level for input to switch U2, allowing device 64 to control switch U2 which shuts down compressor 10.

A description of one method of operation of the present invention, with reference to FIGS. 2 and 3, may be instructional. In the event the oil level in sump 34 falls below threshold level 88, oil level sensing device 64 will either shut down compressor operation or trigger an alarm indication, as discussed above, relating to the low oil level. Upon compressor shut down or alarm indication, a technician may remove oil level sensing device 64 from sight glass fitting 60 by grasping protruding portion 100 and pulling radially outward therefrom. The particular manner of removing oil level sensor 64 from sight glass fitting 60 is unimportant and many known methods may be implemented and are fully contemplated by the present invention. For example, cylinder forward end 196 may have an inner cylindrical surface which is threaded and outward end portion 72 of sight glass fitting 60 may have an outer cylindrical surface which is matingly threaded for rotatably receiving oil level sensor 64 onto sight glass fitting 60. In any event, with oil level sensor 64 removed from sight glass fitting 60, as shown in FIG. 3, a technician may visually inspect interior 70 of compressor 10 by looking through sight glass fitting 60 and prism 62 at opening 90. In this manner, the technician may determine if in fact the oil level in interior 70 of housing 12 has dropped below the acceptable threshold level.

If the technician determines that the oil level has not dropped below the threshold level, then oil level sensor 64 should be inspected to determine if it is defective. If it is defective, then it is a simple manner to replace the defective sensor with a new or reconditioned sensor which may then be installed in sight glass fitting 60. If sensor 64 is not defective, then the technician will know to look elsewhere for the source of the problem. If, after visually inspecting the oil level via sight glass fitting 60 the technician determines that the oil level has in fact dropped below the acceptable threshold level, then the technician knows to inspect the compressor and refrigerant system for sources of that problem. In this manner, the compressor is protected from risk of damage due to insufficient lubricating oil and a technician may easily and cost effectively troubleshoot the source of compressor shutdown without unnecessarily disassembling the compressor or associated equipment.

Figure 4:
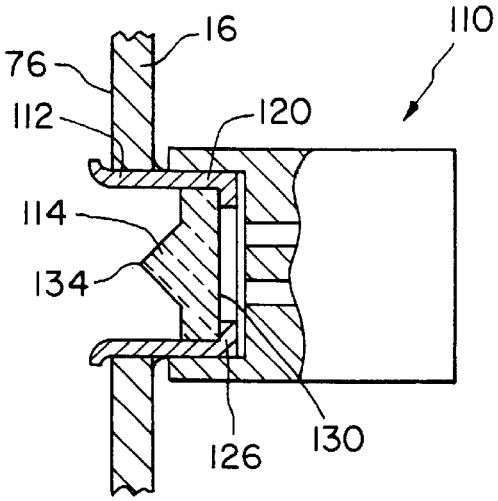
FIGS. 4 and 5 show an alternative embodiment of the sight glass.
Figure 5:
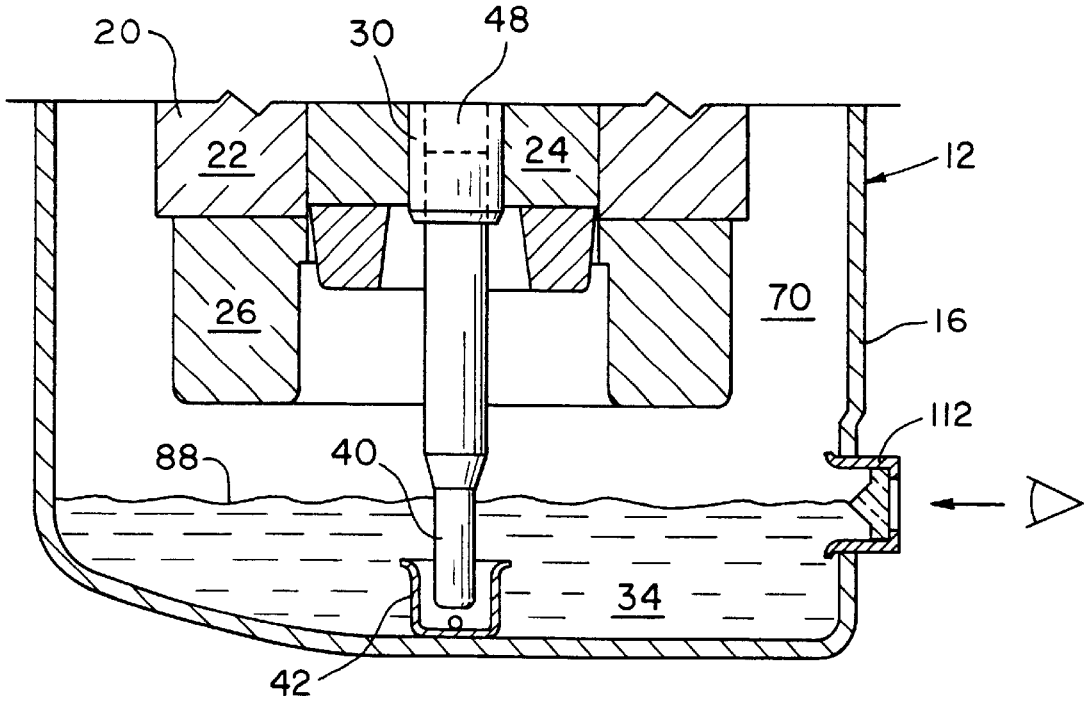

Referring to FIGS. 4 and 5, an alternative oil level sensing and viewing device, referenced generally at 110, is provided in lower housing portion 16 and is hermetically sealed thereto. Oil level sensing/viewing device 110 includes alternative sight glass fitting 112 and prism 114. Fitting 112 includes an outward end portion 120, which extends outwardly from housing 12 and is exposed and readily accessible. Outward end portion 120 is provided with an annular shoulder 126, which engages the outermost portions of rear surface 130 of prism 114. Prism 114 includes outwardly extending point 134 which does not extend past inner surface 76 of lower housing portion 16.

Figure 6:
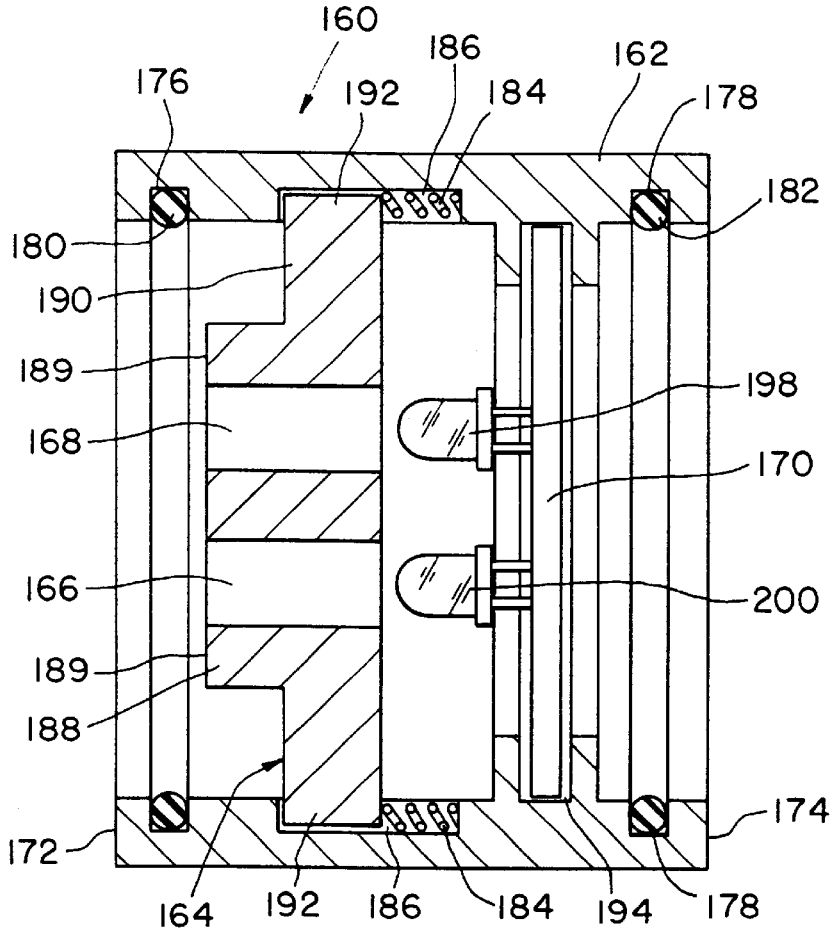
FIG. 6 is a cross-sectional view of an alternate preferred embodiment of the optical sensor.
Figure 7:
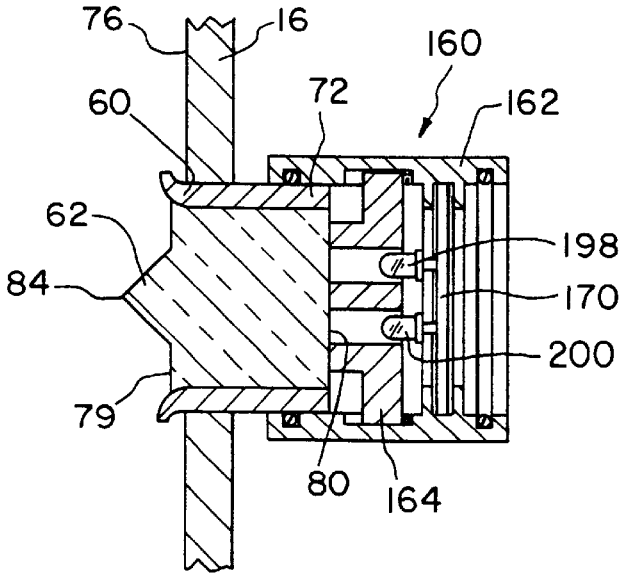
FIG. 7 is a cross-sectional view of the optical sensor of FIG. 6 shown mounted on the sight glass in the housing of a compressor.
Figure 8B:
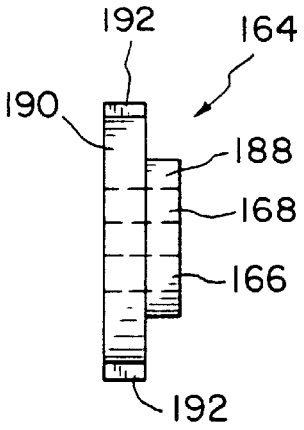
FIG. 8B is a side view of the slidable opaque member of the optical sensor shown in FIG. 6.
Figure 8A:
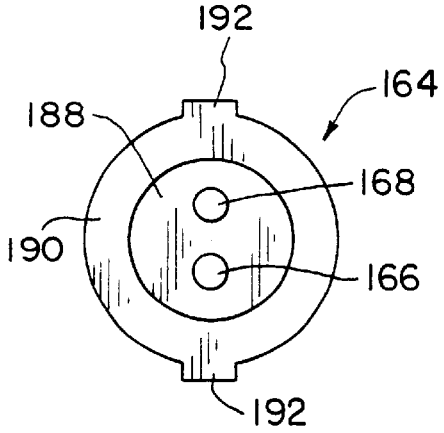
FIG. 8A is a top view of the slidable opaque member of the optical sensor shown in FIG. 6.
Figure 9B:
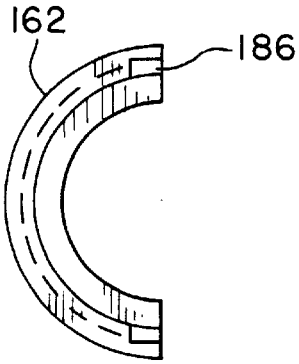
FIG. 9B is an end view of the shell member shown in FIG. 9A.
Figure 9A:
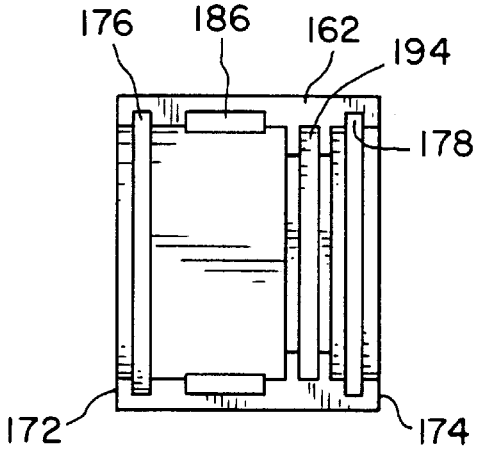
FIG. 9A is a side view of one of the halves of the shell of the optical sensor shown in FIG. 6.

Referring to FIGS. 6 and 7, an alternative oil level sensing device, referenced generally at 160, is provided on sight glass fitting 60. Oil level sensing device 160 includes housing 162, LED 198 and phototransistor 200 mounted on circuit board 170, and opaque member 164. Housing 162 is comprised of two identical halves attached together to form a cylinder. As shown in FIGS. 9A and 9B, each half of housing 162 includes annular grooves 176, 178 for gaskets 180, 182 indents 186 for opaque member 164, and annular pocket 194 for circuit board 170. Opaque member 164 includes bores 166, 168, wide center portion 188, narrow edge portion 190, and tabs 192.

Housing 162 is provided with cylindrical forward portions 172, 174 which surround outwardly extending portion 72 of sight glass fitting 60. Outward end portion 72 provides a stop to limit the movement of oil level sensing device 160 in a direction toward housing 12 with surface 189 portion 188 of opaque member 164 abutting rear surface 80 of prism 62. Opaque member 164 biased toward portions 172, 174 by springs 184 in indents 186 engaging tabs 192 is urged away from portions 172, 174 by portion 72 of fitting 60, inserting LED 198 and phototransistor 200 into bores 168 and 166, respectively. With opaque member 164 in this position, cross coupling between LED 198 and phototransistor 200 is prevented from either sideways coupling or by reflection from rear surface 80 of prism 62. Oil level sensing device 64 may be sealably attached to fitting 60 by O-rings or the like and is external to housing 12 and readily accessible from outside compressor 10. Oil level sensing device 64 may be may be securedly attached to fitting 60 by means such that unintended de-coupling is prevented, or may be easily removable from fitting 60 to permit removal by unaided hand operation.

Other devices can be used in place of opaque member 164 and springs 184 such as a foam compression device or other compressible devices which would function to prevent cross coupling between LED 198 and phototransistor 200 when compressed and to allow cross coupling when not compressed.

The electrical connections between LED 198, phototransistor 200, and the compressor control circuit are identical to that described above for oil sensing device 64. The mounting of LED 198 and phototransistor 200 on circuit board 170 provides support for these items and a location to attach the three required electrical leads.

In operation, oil level sensing device 160 when installed on sight glass fitting 60 works in an identical manner as that of oil level sensing device 64. However, should oil level sensing device 160 fall off or be removed from sight glass fitting 60, opaque member 164 is urged off of LED 198 and phototransistor 200 by springs 184 (FIG. 6). With opaque member 164 removed and nothing between LED 198 and phototransistor 200, sideways coupling occurs and light emitted from LED 198 is detected by phototransistor 200, turning phototransistor 200 on. This provides a low logic level to switch U2 which then shuts down compressor 10. Therefore, oil level sensing device 160 will not allow compressor 10 to run when it is not on sight glass fitting 60 and in a position to detect the oil level in compressor 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic compressor comprising:

a housing;

a motor connected to a controller and having a rotor and a stator, said controller connected to a power source;

a compressor mechanism drivingly connected to said rotor;

an oil sump disposed in said housing; and a combination oil level sensor and viewing device mounted in said housing adjacent said oil sump and comprising:

a sight glass hermetically attached to said housing and adapted to permit optical viewing of said oil sump, whereby the level of oil contained in said oil sump may be observed, said sight glass including a sight glass fitting attached to said housing and a prism portion mounted on said fitting adjacent said oil sump; and an optical sensor removably attached to said sight glass and electrically connected to said controller, said optical sensor including a light source, a photosensitive detector, and an opaque cylinder and adapted to sense the level of oil in said oil sump, said opaque cylinder including a sleeve portion removably mounted externally over said sight glass fitting, said cylinder further including a pair of bores disposed adjacent said prism portion, said light source and said detector being disposed within said bores to thereby prevent cross coupling between said light source and said detector.

2. The compressor of claim 1, wherein with said optical sensor disposed on said sight glass and sensing a low oil level in said oil sump, said optical sensor provides a low oil level signal to said controller, said controller includes means for interrupting power to said motor, thereby terminating compressor operation.

3. The compressor of claim 1, wherein said prism portion is disposed along a plane lying outside an inner periphery of said housing.

4. The compressor of claim 1, wherein said fitting and said sleeve portion are generally cylindrical with said sleeve portion having an inner diameter greater than the outer diameter of said fitting, whereby said optical sensor sleeve may be placed over and about said fitting and removed therefrom repeatedly by unaided hand operation.

5. The compressor of claim 1, wherein said optical sensor includes three electrical leads disposed outside said housing and interconnected with said controller external of said housing, whereby said optical sensor sensing a low oil level condition within said oil sump provides a low oil level signal to said controller, said controller including means for terminating compressor operation.

6. A hermetic compressor comprising:

a housing;

a motor connected to a controller and having a rotor and a stator, said controller connected to a power source;

a compressor mechanism drivingly connected to said rotor;

an oil sump disposed in said housing; and a combination oil level sensor and viewing device mounted on said housing adjacent said oil sump and comprising:

a sight glass hermetically attached to said housing and adapted to permit visual inspection of said oil sump, whereby the level of oil contained in said oil sump may be observed; and an optical sensor removably attached to said sight glass and electrically connected to said controller, said optical sensor adapted to sense the level of oil in said oil sump and including a housing; a light source, a photosensitive detector, and a blocking mechanism disposed in said housing, said blocking mechanism including a blocking member having a first position and a second position within said sensor housing, said first position disposed between said light source and said detector preventing optical cross coupling when said optical sensor is attached to said sight glass, said blocking member biased to said second position disposed away from said light source and said detector allowing cross coupling when said optical sensor is removed from said sight glass, whereby said optical sensor provides a low oil level signal to said controller when said optical sensor is removed from said sight glass.

7. The compressor of claim 6, wherein said optical sensor includes a spring that biases said blocking member to said first position away from said light source and said photosensitive detector.

8. The compressor of claim 6, wherein said optical sensor includes a circuit board within said sensor housing, said light source and said photosensitive detector are mounted on said circuit board.

9. The compressor of claim 6, wherein said sensor housing includes two identical C-shaped sections mated together.

10. The compressor of claim 6, wherein said blocking member includes a pair of bores to receive said light source and said photosensitive detector therein.

11. The compressor of claim 6, wherein said sight glass urges said blocking member from said second position to said first position, when said optical sensor is attached to said sight glass.

12. The compressor of claim 6, wherein said sight glass maintains said blocking member in said first position with said optical sensor attached to said sight glass.

13. A hermetic compressor comprising:

a housing;

a motor connected to a controller and having a rotor and a stator, said controller connected to a power source;

a compressor mechanism drivingly connected to said rotor;

an oil sump disposed in said housing; and a combination oil level sensor and viewing device mounted on said housing adjacent said oil sump and comprising:

a sight glass hermetically attached to said housing and adapted to permit optical viewing of said oil sump, whereby the level of oil contained in said oil sump may be observed; and an optical sensor removably attached to said sight glass and electrically connected to said controller, said optical sensor adapted to sense the level of oil in said oil sump and including a housing; a light source, a photosensitive detector, an opaque member, and at least one spring disposed in said housing, said opaque member including a pair of bores to receive said light source and said detector and having a first position and a second position, said spring biasing said opaque member into said second position, said light source and said detector disposed within said opaque member in said first position and disposed outside opaque member in said second position, said sight glass maintains said blocking member in said first position with said optical sensor attached to said sight glass, whereby said optical sensor provides low oil level signal to said controller when said optical sensor is removed from said sight glass.

14. The compressor of claim 13, wherein said optical sensor includes a circuit board within said sensor housing, said light source and said photosensitive detector are mounted on said circuit board.

15. The compressor of claim 13, wherein said sensor housing includes two identical C-shaped sections mated together.

* * * * *